United States Patent [19]

Thiele

[11] Patent Number: 5,048,436

[45] Date of Patent: Sep. 17, 1991

[54] ROTARY LOOPER FOR A LOCKSTITCH SEWING MACHINE

[75] Inventor: Horst Thiele, Bielefeld, Fed. Rep. of Germany

[73] Assignee: Durkopp Adler AG, Fed. Rep. of Germany

[21] Appl. No.: 505,554

[22] Filed: Apr. 6, 1990

[30] Foreign Application Priority Data

Apr. 6, 1989 [DE] Fed. Rep. of Germany ..... 3911134

[51] Int. Cl.[5] ..... D05B 57/08; D05B 57/26; D05B 57/14

[52] U.S. Cl. ..... 112/228; 112/229; 112/231; 112/232

[58] Field of Search ..... 112/38, 181, 188, 189, 112/191, 228, 229, 230, 231, 467, 232, 233

[56] References Cited

U.S. PATENT DOCUMENTS

| | | | |
|---|---|---|---|
| 1,702,383 | 2/1929 | Hemleb | 112/188 |
| 2,555,658 | 6/1951 | Ritter | 112/229 |
| 2,949,874 | 8/1960 | Kuhar | 112/231 |
| 3,381,643 | 5/1968 | Meloy, Jr. | 112/181 |
| 3,596,620 | 8/1971 | Vogel | 112/228 |
| 3,682,121 | 8/1972 | Kasawaki | 112/231 |
| 4,235,178 | 11/1980 | Ackermann | 112/229 |
| 4,284,017 | 8/1981 | Starr | 112/181 |
| 4,434,734 | 3/1984 | Russell | 112/181 |
| 4,572,091 | 2/1986 | Gustmann et al. | |
| 4,601,250 | 7/1986 | Clement | 112/230 |
| 4,676,178 | 6/1987 | Hirose | 112/231 |

FOREIGN PATENT DOCUMENTS

| | | | |
|---|---|---|---|
| 832839 | 1/1952 | Fed. Rep. of Germany | |
| 1093182 | 11/1960 | Fed. Rep. of Germany | |
| DE3244946 | 4/1984 | Fed. Rep. of Germany | |
| 1022284 | 1/1989 | Japan | 112/228 |
| 1268591 | 10/1989 | Japan | 112/181 |

*Primary Examiner*—Werner H. Schroeder
*Assistant Examiner*—Sullivan C. Prak

[57] ABSTRACT

A rotary looper for a lockstitch sewing machine, which can receive either a coreless thread package or a thread-wound bobbin. An upper bobbin-housing part is provided with two separate thread-tensioning elements and with respective thread-guide slots associated with them. In this way, the thread withdrawn either from a coreless thread package or a looper-thread bobbin passes over an optimally-shaped thread path on its way to the sewing area, and in both cases, a specifically adapted thread-tensioning force is exerted on the thread withdrawn. Preferably, the front part of the thread supply, in the coreless package or bobbin, can be accommodated in front of the movement path of the sewing needle, whereby the bobbin-housing can accommodate an extra-wide thread supply. An upwardly extended shoulder is provided on the lower part of the bobbin housing, so that the axially widened needle thread loop can slide unimpeded over the axially-extended bobbin-housing upper part. Preferably, there is also an oblique guide surface on the rear of the lower bobbin-housing part for further facilitating the passage of the needle thread loop.

13 Claims, 5 Drawing Sheets

ROTARY LOOPER FOR A LOCKSTITCH SEWING MACHINE

BACKGROUND OF THE INVENTION

The present invention relates to an improved rotary looper for lockstitch sewing machines in which either a coreless thread package or a bobbin wound with thread can be received.

A conventional rotary looper comprises: a looper body which is mounted on a looper shaft, having a looper tip which grips the needle thread loop, and an inner guide which is arranged concentrically to the looper shaft; a lower bobbin-housing part which has an outer guide rib and defines a hollow for receiving the thread supply; and an upper bobbin-housing part which is equipped with a centrally arranged thread guide hole, receives the looper thread supply, is mounted in the lower bobbin-housing part, and is held in form-locked manner in the lower bobbin-housing part by at least one radially displaceable blocking member.

One prior rotary looper is known from German Patent 832,839. In accordance therewith it is possible for the looper to receive either a coreless thread package, known from German Patent 1,093,182, or a traditional bobbin wound with thread The upper bobbin-housing part of the known looper is provided at its end with an adjustable tensioning element. It is designed optimally to receive a coreless thread package, since the thread withdrawn from the center of the thread package need pass only one point of deflection on its path to the sewing area. When a traditional bobbin is placed in the upper bobbin-housing part, the thread is withdrawn from the outside diameter of the thread package on this bobbin, not the center, so the thread must be pulled over the two edges of a flange on the bobbin in order to then pass through the thread guide hole which is located centrally in the upper part of the bobbin housing. Thus, a disadvantage of the known looper is that the thread withdrawn from a traditional looper-thread bobbin is subjected to considerable frictional forces.

With respect to the largest possible supply of looper thread which is obtainable with the invention, it is known per se from the prior art (German Patent 409,711) to arrange the upper part of the bobbin housing eccentrically to the looper-shaft in the lower part of the bobbin housing, and to lengthen the upper part of the bobbin housing axially.

SUMMARY OF THE INVENTION

Accordingly, the main object of the present invention is to provide an improved rotary looper wherein the thread withdrawn from the largest possible looper-thread supply passes over an optimally formed thread path on its way to the sewing area, both when using a coreless thread package and when using a traditional looper-thread bobbin.

According to an important aspect of the invention, this object is achieved by a rotary looper in which separate first and second thread-tensioning elements and thread withdrawal paths are provided on the upper bobbin-housing part.

Thus, in a looper according to the invention, the thread withdrawn from it can be acted on by a specific one of the two separate thread-tensioning elements depending on whether the looper-thread supply is a coreless thread package or a traditional bobbin. The thread-tensioning elements and thread paths are so arranged on the upper part of the bobbin housing that each of them is favorable for withdrawal of thread from one respective type of thread supply, so that optimal withdrawal of the thread is assured.

Advantageously, the upper bobbin-housing part is also lengthened axially to such an extent that a front edge of the looper thread supply lies in front of the path of movement of the sewing needle, permitting an extra-wide thread supply to be received, and further defining the optimal thread paths.

It is furthermore advantageous that in view of the different weights of a coreless thread package and a traditional bobbin, the tensioning force of each thread-tensioning element can be adjusted individually according to the corresponding type of looper-thread supply. Thus the necessity to readjust the thread-tensioning force, which is conventionally unavoidable when changing from one type of supply to the other, is avoided in the solution of the invention.

As a result of the compact construction of the looper, the outside diameter of which has been kept the same as in traditional loopers, and despite the axial lengthening of the upper part of the bobbin housing, the needle thread loop is only required to be slightly larger in order to be able to pass around the lower part and the upper part of the bobbin housing. Therefore, no corresponding changes in the thread-feeder are required.

Finally, there is the advantage that by not increasing the outside diameter of the looper, it is possible to use a thread cutting device which is designed for traditional lockstitch loopers.

Many other advantageous and novel features of the looper assembly are disclosed and claimed herein.

BRIEF DESCRIPTION OF THE DRAWINGS

Other objects, features and advantages of the invention will be appreciated from the following detailed description of an embodiment thereof, with reference to FIGS. 1 to 14 of the drawings.

DETAILED DESCRIPTION OF A PREFERRED EMBODIMENT

Figure 1:
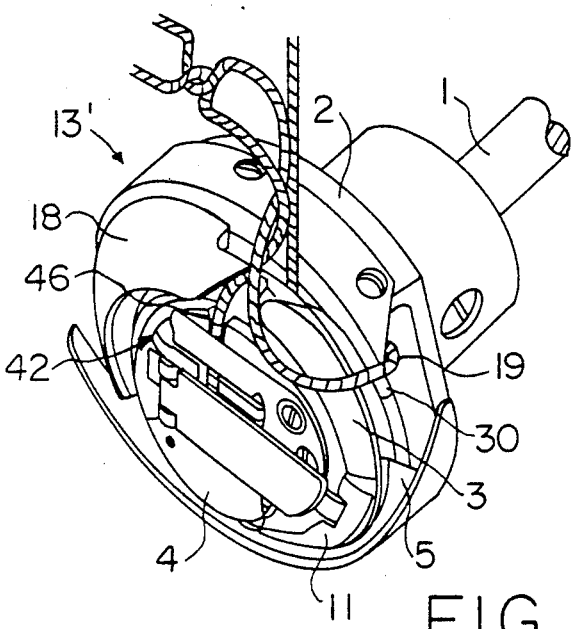
FIG. 1 is a perspective view of the looper loaded with a coreless thread package, shortly before the end of a sewing stitch.
Figure 2:
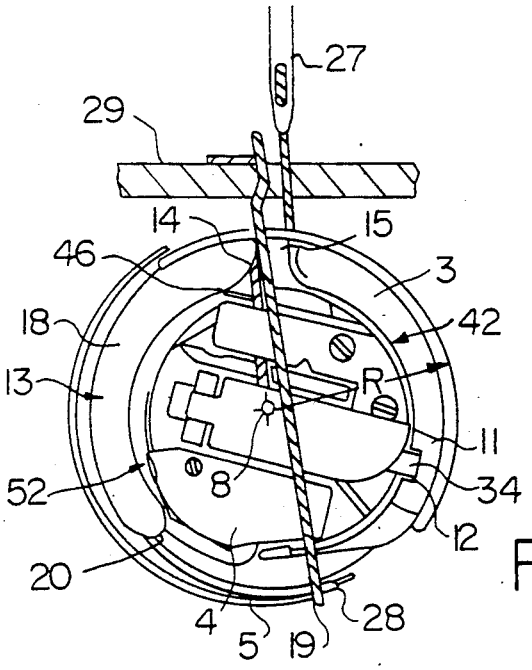
FIG. 2 is a front view of the looper loaded with a coreless thread package.
Figure 3:
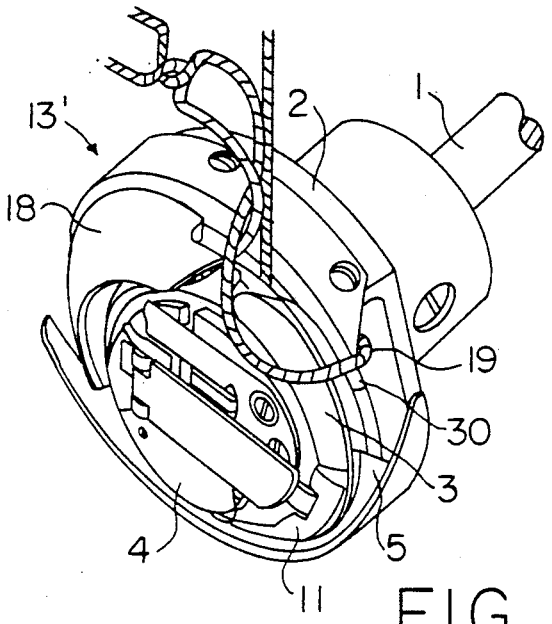
FIG. 3 is a perspective view of the looper loaded with a traditional looper-thread bobbin, shortly before the completion of the sewing stitch.

FIGS. 1 and 3 are perspective views of a rotary looper for a lockstitch sewing machine of traditional construction, not shown here. The looper includes a looper body 2 driven by a horizontally mounted looper shaft 1, a lower bobbin-housing part 3, and an upper bobbin-housing part 4. The upper and lower bobbin-housing parts 3, 4, as known, are not turnable with respect to each other. On the looper body 2 there is a looper tip 5 which at the proper time receives the needle thread loop 19 and moves it in accordance with FIGS. 2 and 4 around the looper-thread supply.

Figure 5:
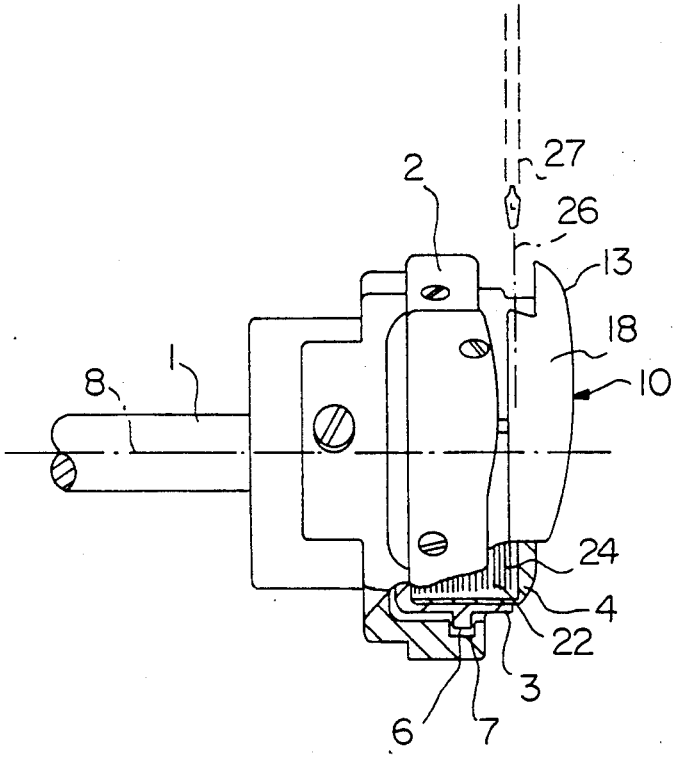
FIG. 5 is a side view of the looper loaded with a coreless thread package.
Figure 6:
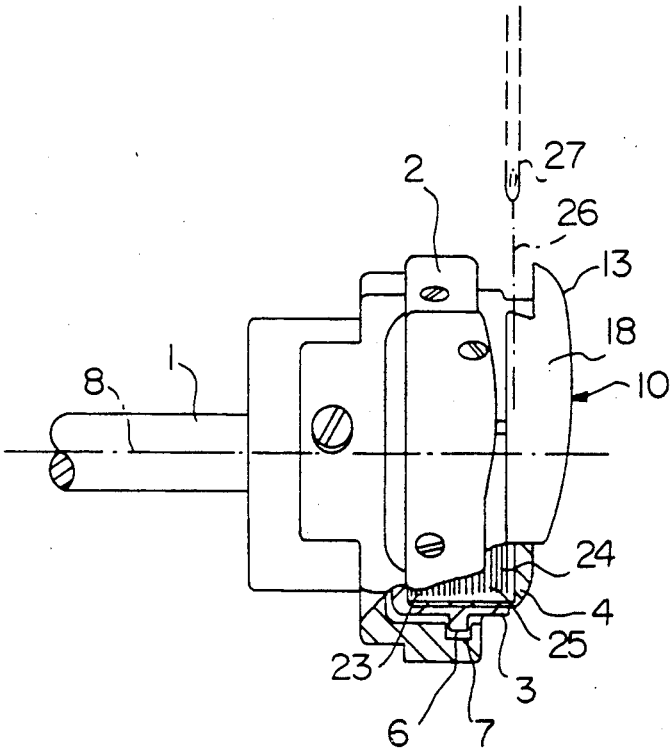
FIG. 6 is a side view of the looper loaded with a traditional looper-thread bobbin.
Figure 7:
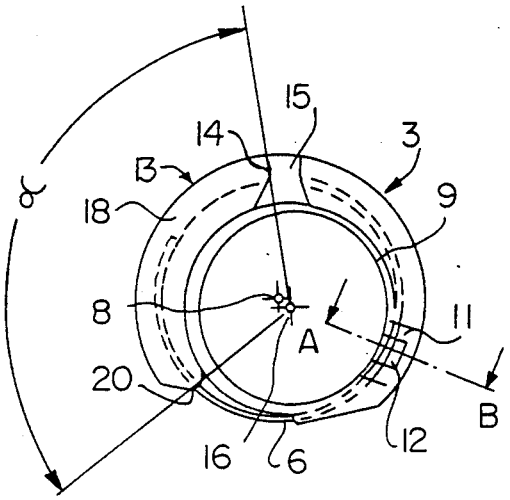
FIG. 7 is a front view of the lower part of the bobbin housing.
Figure 8:
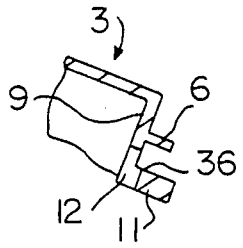
FIG. 8 is a sectional view of the lower part of the bobbin housing, taken along the section line A–B of FIG. 7.
Figure 10:
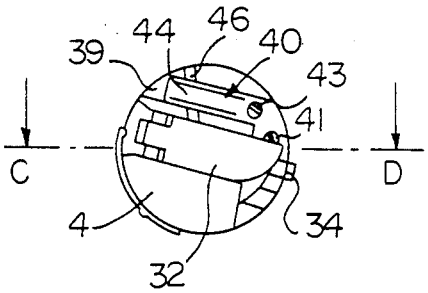
FIG. 10 is a front view of the upper part of the bobbin housing.
Figure 9:
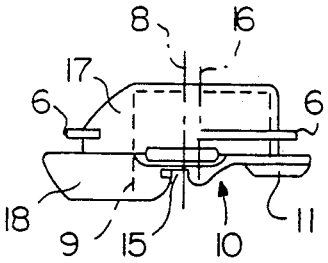
FIG. 9 is a top view of the lower part of the bobbin housing.
Figure 11:
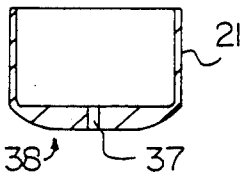
FIG. 11 is a very simplified showing in cross-section of the upper part of the bobbin housing, taken along the section line C–D of FIG. 10.

The lower part 3 of the bobbin housing is provided on its circumferential surface with a guide rib 6 which is received in form-locked manner by a guide 7 provided in the looper body 2 (see FIGS. 5 and 6). Eccentric to a center of rotation 8 of the looper shaft 1, a hollow 9 is arranged in the lower part 3 of the bobbin housing. (FIGS. 7–9.) Thus the hollow 9 is also eccentric to the guide rib 6.

At one end 10 of the lower part 3 a thickening 11 is formed, which, as shown in FIGS. 8 and 9, represents a partially forward extended part at the end 10. The thickening 11 is adjacent to a recess 12 which, in accordance with FIG. 8, interrupts the hollow 9 near the end 10 and opens into the hollow 9.

Figure 4:
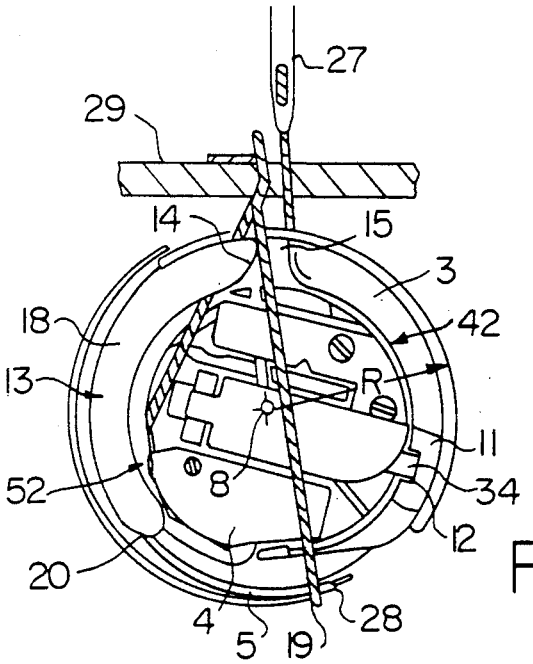
FIG. 4 is a front view of the looper loaded with a traditional looper-thread bobbin.

As shown in FIGS. 1 to 4 and 7, an upward and forward extended shoulder 13 is provided on the lower part 3 of the bobbin housing on a loop receiving side 13', the shoulder 13 being approximately diametrically opposite the recess 12. An end point 14 of the shoulder 13 coincides with the front edge of a groove 15 which is provided, as shown in FIGS. 2, 4 and 7, in the lower part 3 of the bobbin housing.

In known manner a holding means (not shown) engages in the groove 15 and prevents the rotating looper body 2 from carrying the lower part 3 of the bobbin housing along with it in rotation.

As shown in FIG. 9, on the rear of the lower part 3 of the bobbin housing there is an oblique surface 17, which extends concentrically to a center 16 of the hollow 9, which ensures that with the looper of the present invention, only a slightly larger amount of needle thread is pulled out for the looping process, as compared with a conventional looper.

The above-described shoulder 13 has a curved slide surface 18 which extends around the center 16 and is polished to present a smooth surface to the thread with rounded edges on all sides. The slide surface 18 is conical and slightly barreled, and slightly convex towards the outside. In the axial direction of the lower part 3 of the bobbin housing, the shoulder 13 is extended up and forward so far that a needle thread loop 19 which is moved around the lower part 3 and the upper part 4 of the bobbin housing can slide unimpeded over the end 10 of the lower part 3 of the bobbin housing. The curvilinear longitudinal extension of the shoulder 13 is limited by the end point 14 and another end point 20. As shown in FIG. 7, the end points 14, 20 define the legs of the angle $\alpha$, with respect to the center 16, which preferably is substantially 90 to 160 degrees.

The upper part 4 of the bobbin housing which is received by the lower part 3 of the bobbin housing is enlarged in the axial direction; that is a collar 21 on said upper part is lengthened toward the distal or forward side of the upper part 4. In this way, the upper part 4 of the bobbin housing can receive either a correspondingly wide coreless thread package 22 (see FIG. 5) or a correspondingly wide bobbin 23 (see FIG. 6), both of which, but particularly the thread package 22, hold a considerably larger amount of looper thread than a traditional looper.

As a result of the aforementioned axial lengthening of the upper part 4 of the bobbin housing, and the presence of the wide thread package 22 or wide bobbin 23, a front edge 24 of the thread supply (the thread package 22 in FIG. 5, or a package 25 located on the bobbin 23 in FIG. 6) lies in front of a path of movement 26 of a sewing needle 27 forming part of the double saddle-stitch sewing machine.

If the point of the sewing needle 27 descends so far that it enters into the looper thread supply, it is advisable to bend the looper tip 5 slightly outward in tangential direction so that a point 28 of the looper tip 5 now has a greater distance from the center of rotation 8 than the radius R defined by the looper tip 5 about the center of rotation 8 (see FIGS. 2 and 4). A needle bar (not shown) which guides the sewing needle 27 can be adjusted in known manner upwards, away from the throat plate 29, by the amount of the aforementioned displacement of the point 28. The person skilled in the art will understand that the amount of the bending of the looper tip 5 is limited by manufacturing requirements and the nature of the material it is made of. It should also be considered in this connection that the needle thread loop 19, which at the proper moment slides off of the looper tip 5, is to be caught dependably by a mating tip 30, in accordance with FIGS. 1 and 3.

Referring now to FIGS. 10–14 in particular, a blocking member 31 has a swingable opening lever 32 and a flap 33 which is mounted for radial displacement in the upper part 4 of the bobbin housing. The blocking member 31 is well known and need not be described in further detail. By swinging the opening lever 32 inward (FIG. 14), a holding hook 34 provided on the flap 33 can be displaced radially toward the center 16 of the upper part 4 of the bobbin housing. When the opening lever 32 is swung inward, the holding hook 34 is moved so far into the recess 12 that a holding surface 35 comes to rest against a lower surface 36 of the thickening 11. In this way, the upper part 4 of the bobbin housing is connected in form-locked manner with the lower part 3 into which it is inserted.

Figure 14:
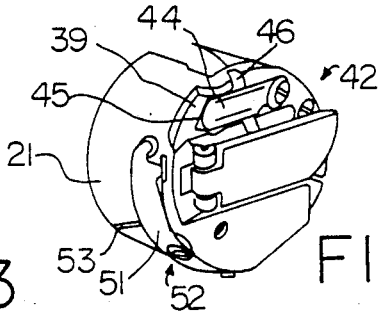
FIG. 14 is a perspective view of the upper part of the bobbin housing, viewed from the left.

In the center of the upper part 4 of the bobbin housing there is a thread guide hole 37, the two openings of which have rounded edges. On one end 38 (FIG. 11) of the upper part 4 there is an angularly-extending groove 39 (FIG. 10) having a depth of about 2 millimeters in which a leaf spring 40 is fastened by a screw 41. The leaf spring 40 provides a first thread-tensioning element 42 and the spring force it exerts can be varied by an adjustment screw 43. One leg 44, as shown in FIG. 14, has a convex cross-section 45 which permits the gentlest possible passage of the thread withdrawn from the looper thread supply (see FIG. 1). Transverse to the groove 39 there is a thread guide slot 46 which is about 1 to 2 millimeters deeper than the groove 39 (see FIGS. 10 and 14).

In the collar 21 there is a threading hole 47 (FIG. 12) which is connected by another thread guide slot 48 to the thread guide hole 37.

Figure 12:
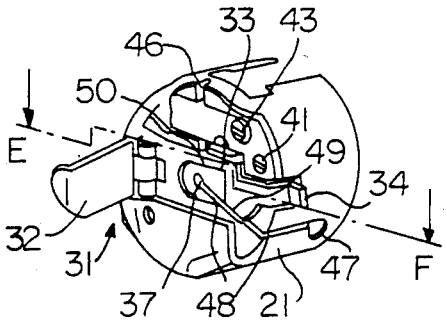
FIG. 12 is a perspective view of the upper part of the bobbin housing, seen from the right.
Figure 13:
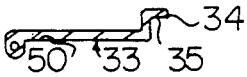
FIG. 13 is a sectional view of the flap which forms part of the blocking member, taken along the section line E–F of FIG. 12.

Another thread guide slot 49 and a groove 50 are provided in the flap 33 (see FIGS. 12, 13).

On the circumference of the collar 21 there is a circularly bent leaf spring 51 (FIG. 14) which provides a second thread-tensioning element 52, as well as an oblique thread guide slot 53. Such a leaf spring and guide slot have been known for a long time from the prior art and do not need to be described in further detail here.

The manner of operation of this embodiment of the invention is described below:

As shown in FIGS. 1 and 2 and 5, when a coreless thread package 22 is placed in the upper part 4 of the bobbin housing, a length of thread pulled out of the center of said package is threaded through the threading hole 47 and then brought, via the thread guide slot 48, into the thread guide hole 37. The piece of thread is then pulled through the groove 50 below the leg 44 of the leaf spring 40 and then conducted through the thread guide slot 46, in accordance with FIGS. 1 and 2. The upper part 4 of the bobbin housing is then inserted in known manner into the lower part 3 and locked by the holding hook 34. In this way, the thread withdrawn from the thread package 22 is acted on by the first thread-tensioning element 42.

As seen in FIGS. 3, 4 and 6, when a wide bobbin 23 wound with looper thread is placed in the upper part 4 of the bobbin housing, the thread passing from the outside diameter of the package 25 is pulled through the thread guide slot 53 and below the leaf spring 51. In this way, the looper thread withdrawn from the bobbin 23 is tensioned by the second thread-tensioning element 52.

Although the present invention has been described in relation to particular embodiments thereof, many other variations and modifications and other uses will become apparent to those skilled in the art. Therefore, the present claims should not be construed as limited by the specific disclosure herein, but also to include all modifications and variations fairly within its teachings.

What is claimed is:

1. A rotary looper for a lockstitch sewing machine for receiving either a coreless thread package or a bobbin wound with thread; said rotary looper comprising:

a looper body which is mounted to be driven by a looper shaft, said looper shaft generally defining an axial direction, said looper body having a looper tip which is operable for gripping and guiding a needle thread loop of said sewing machine;

a lower bobbin-housing part radially within said looper body and having an eccentric hollow for receiving an upper bobbin-housing part;

an upper bobbin-housing part having an inner space which receives said coreless thread package or bobbin; and being mounted in the eccentric hollow of the bobbin-housing lower part;

first and second independent thread-tensioning elements on the upper bobbin-housing part; and path means on said upper bobbin-housing part defining respective thread paths from said inner space within the upper bobbin-housing part, to said first and second thread-tensioning elements.

2. A looper according to claim 1, wherein the upper bobbin-housing part is lengthened axially to such an extent that a front portion of the looper thread supply within the upper bobbin-housing part is disposed axially in front of a path of movement of a sewing needle of the sewing machine.

3. A looper according to claim 1, wherein the first thread-tensioning element is provided on an axial end of the upper bobbin-housing part and the second thread-tensioning element is provided on a collar means which is comprised in the circumferential surface of the upper bobbin-housing part; and said path means comprises a first or a second thread-guide slot means which lead from the space within the upper bobbin-housing part to each respective thread-tensioning element.

4. A looper according to claim 3, wherein the upper bobbin-housing part has a generally axial central thread guide hole; and said first slot means comprises at least one groove on an axially forward end of said upper bobbin-housing part, which runs generally upward toward the needle of the sewing machine, from said central thread guide hole.

5. A looper according to claim 4, wherein said at least one groove, comprises:

a generally angularly-extending first groove, above said central thread guide hole on said axially forward end; and a generally vertical first thread guide slot extending generally upward from said first groove.

6. A looper according to claim 5, wherein said vertical first thread guide slot is deeper than said first groove.

7. A looper according to claim 4, wherein the first thread-tensioning element is a generally horizontally extending leaf spring having a leg with a rearward-facing convex cross-section; and the leaf spring is received by said at least one groove.

8. A looper according to claim 5, wherein said upper bobbin-housing part is secured to said lower bobbin-housing part by a blocking member, and a portion of said blocking member has formed therein a second groove which communicates between said central thread guide hole and said first angularly-extending groove; and a second thread guide slot which extends radially outward from said central thread guide hole.

9. A looper according to claim 2, wherein the lower bobbin-housing part has a loop-receiving side with an upward- and forward-extending shoulder means arranged at the axially forward end of the bobbin-housing lower part for facilitating the passage of the needle-thread loop past said upper bobbin-housing part.

10. A looper according to claim 9, wherein said lower part also has a thickening located substantially diametrically opposite the shoulder.

11. A looper according to claim 9, wherein said lower part further has an obliquely angled surface means axially rearward from said shoulder means for further facilitating the passage of the needle-thread loop.

12. A looper according to claim 1, wherein said looper body has a radially inward guide which is arranged concentrically to the looper shaft; and said lower bobbin-housing part has a guide rib engaging the guide on the looper body.

13. A looper according to claim 4, wherein said first slot means further comprises at least one slot which runs to said central thread guide hole from a threading hole in said collar means

* * * * *